US006612803B1

(12) United States Patent
McCartney et al.

(10) Patent No.: US 6,612,803 B1
(45) Date of Patent: Sep. 2, 2003

(54) POSITIONING CRADLE FOR MINE ROOF SUPPORTS

(75) Inventors: Clifford A. McCartney, Eighty-Four, PA (US); William A. Anderson, Mt. Lake Park, MD (US)

(73) Assignee: Strata Products (USA), Inc., Marietta, GA (US)

( * ) Notice: Subject to any disclaimer, the term of this patent is extended or adjusted under 35 U.S.C. 154(b) by 0 days.

(21) Appl. No.: 09/506,472

(22) Filed: Feb. 17, 2000

(51) Int. Cl.[7] ..... B66F 9/18

(52) U.S. Cl. ..... 414/739; 294/104; 294/117; 405/288; 414/607

(58) Field of Search ..... 414/23, 607, 739; 405/288, 291, 292; 294/104, 117

(56) References Cited

U.S. PATENT DOCUMENTS 3,479,078 A * 11/1969 Doty ..... 294/104
3,937,340 A * 2/1976 Grove ..... 414/23 X
4,280,785 A * 7/1981 Albrecht ..... 414/23 X
4,318,661 A * 3/1982 Helm ..... 414/607
4,615,656 A * 10/1986 Geraghty, Jr. ..... 414/607
5,073,080 A * 12/1991 Blum ..... 414/23 X
5,377,730 A * 1/1995 Hamilton ..... 414/23 X
5,383,758 A * 1/1995 Patrick ..... 414/607
5,746,564 A * 5/1998 McPherson ..... 414/607
5,795,107 A * 8/1998 Edmondson et al. ..... 405/303

FOREIGN PATENT DOCUMENTS

SU 312818 * 8/1971 ..... 414/23

* cited by examiner

*Primary Examiner*—Janice L. Krizek
(74) *Attorney, Agent, or Firm*—Ansel M. Schwartz

(57) ABSTRACT

A cradle for placing a support in a mine. The cradle includes a housing for holding the mine support. The cradle includes an arm mechanism rotatably attached to the housing which has an open position that allows the support to enter the housing and a closed position which prevents the support from leaving the housing. The cradle includes an attachment mechanism connected to the housing for rotatably attaching the housing to a platform of a mechanism for moving the mine support. The attachment mechanism maintains the housing in the horizontal position or a vertical position. A method for placing a support in a mine. The method includes the steps of moving a support from a platform to a cradle. Then there is the step of rotating the cradle until the support is in a vertical position relative to ground. Next there is the step of placing the support on the ground. Then there is the step of separating the support from the cradle. Next there is the step of tensioning the support with the mine roof.

10 Claims, 16 Drawing Sheets

POSITIONING CRADLE FOR MINE ROOF SUPPORTS

FIELD OF THE INVENTION

The present invention is related to the placement of mine roof supports in a mine. More specifically, the present invention is related to the placement of mine roof supports in a mine with the use of a cradle.

BACKGROUND OF THE INVENTION

Standing supports such as timber cribs, timber posts have long been used in underground mining. In most cases, the components of these supports were light enough that one or two men could easily install the support. With the development of large diameter and monolithic support systems (such as the "Star Prop" and "The Can") the supports while efficient and productive, have become too large for one or two men to practically install. Means of mechanical installation are necessary to use these products practically. One such means is to attach a paper roll clamp type device onto a piece of mobile underground equipment (normally a battery or diesel powered "scoop") that can grab and maneuver the support into the desired installed position. This clamp system while adequate is large and cumbersome and greatly oversize for the installation of the smaller "Cans" and the Star Prop. Additionally, the clamp type device requires hydraulic power to securely grab and maneuver the supports thus adding to the complexity of the system and reducing the reliability. Another drawback of the clamp device and its complexity is that it is not easily connected and disconnected to the "scoop". Scoops are typically manufactured with a forklift, load carrying bucket or flat load platform (duck bill) configuration at its load carrying end to easily pick up and discharge materials. These devices must be removed to install the clamp type device. The result of this is that the equipment to which the clamp is attached becomes dedicated to the single function of placing the supports. Any additional work that was normally performed by this machine requires the employment of another machine.

SUMMARY OF THE INVENTION

The present invention pertains to a cradle for placing a support in a mine. The cradle comprises a housing for holding the mine support. The cradle comprises an arm mechanism rotatably attached to the housing which has an open position that allows the support to enter the housing and a closed position which prevents the support from leaving the housing. The cradle comprises an attachment mechanism connected to the housing for rotatably attaching the housing to a platform of a mechanism for moving the mine support. The attachment mechanism maintains the housing in the horizontal position or a vertical position.

The present invention pertains to a method for placing a support in a mine. The method comprises the steps of moving a support from a platform to a cradle. Then there is the step of rotating the cradle until the support is in a vertical position relative to ground. Next there is the step of placing the support on the ground. Then there is the step of separating the support from the cradle. Next there is the step of tightening the support to the mine roof.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
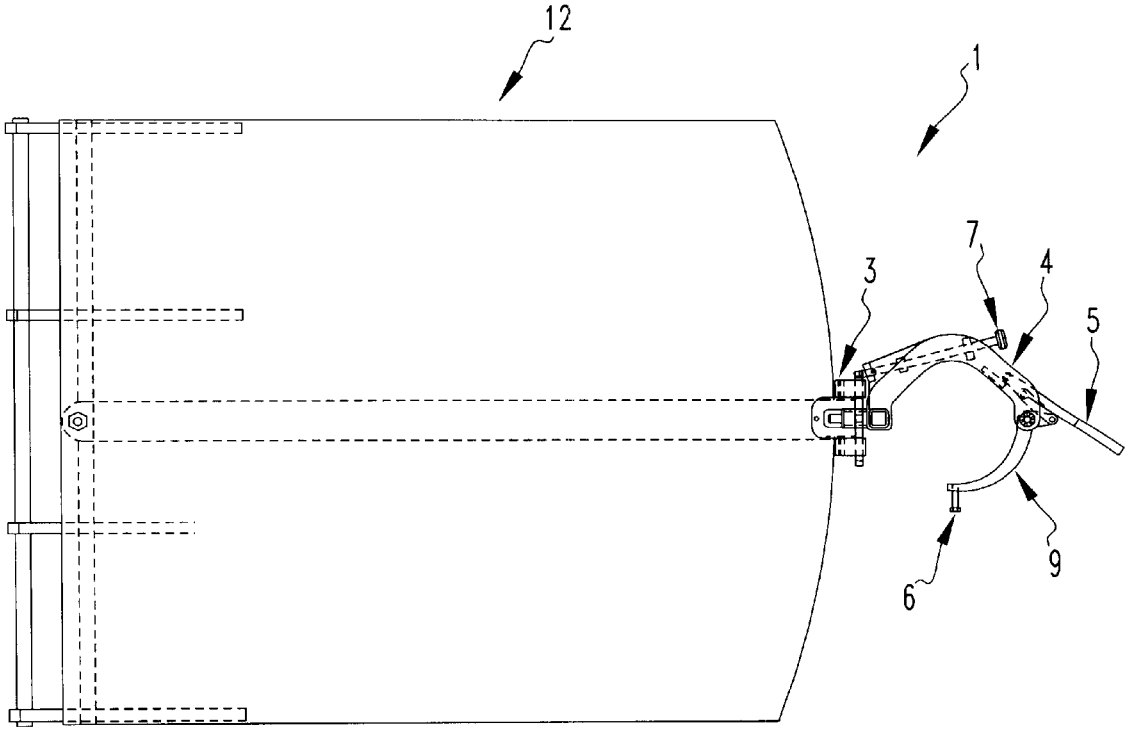
FIG. 1 is a schematic representation of an overhead view of a cradle with a platform.
Figure 2:
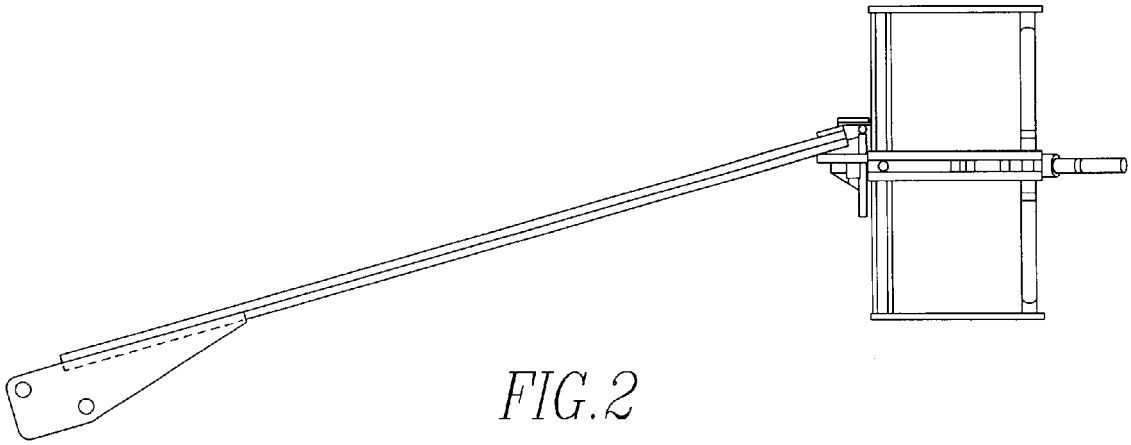
FIG. 2 is a schematic representation of a side view of a cradle with a platform.
Figure 3:
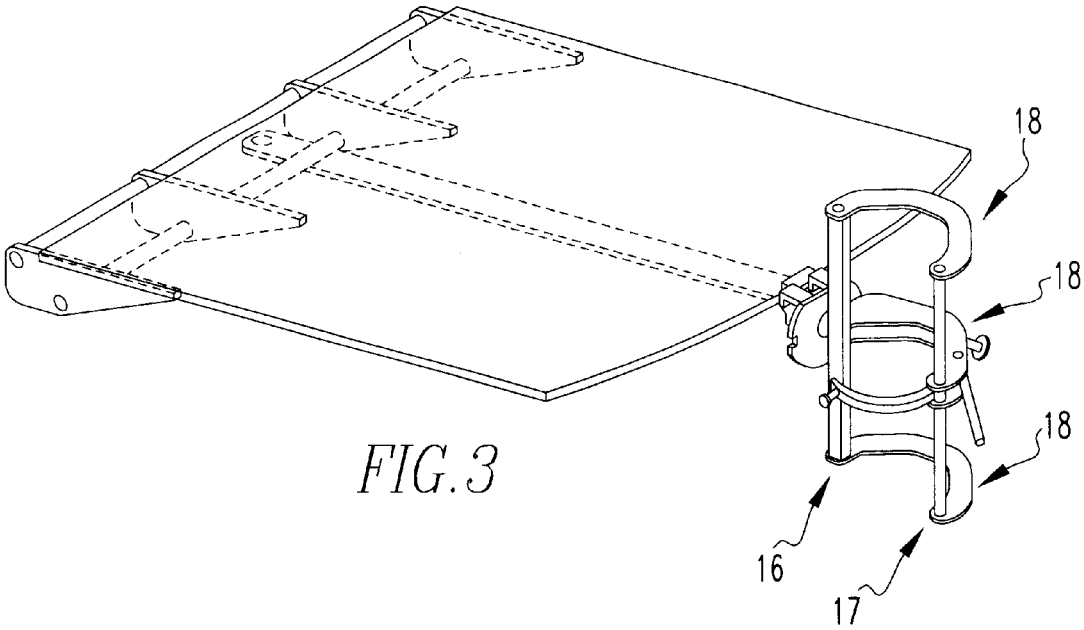
FIG. 3 is a schematic representation of a perspective view of a cradle with a platform.
Figure 4:
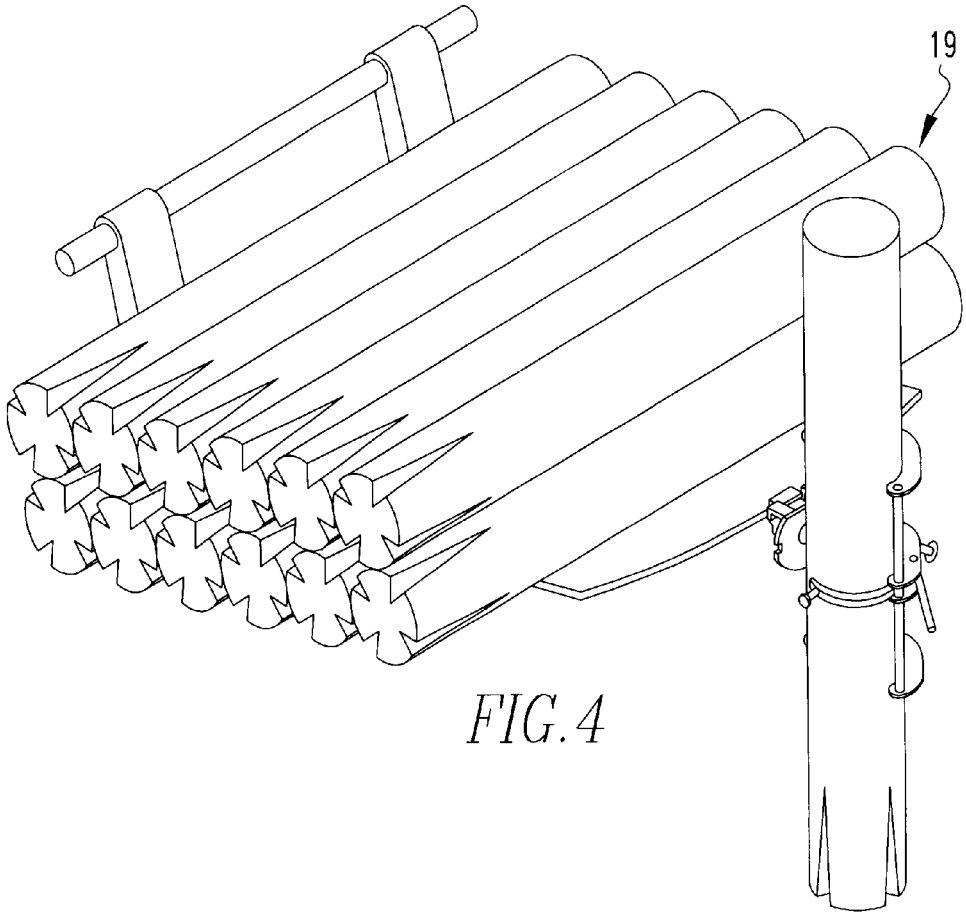
FIG. 4 is a schematic representation of a cradle with a platform having supports.
Figure 5:
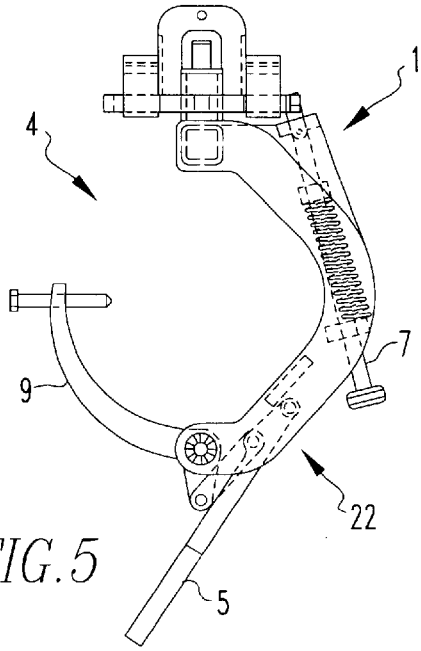
FIGS. 5, 6, 7 and 8 are schematic representations of various views of a cradle.
Figure 7:
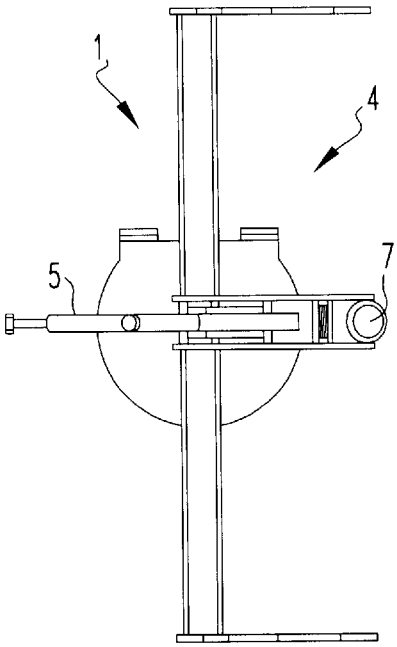
Figure 8:
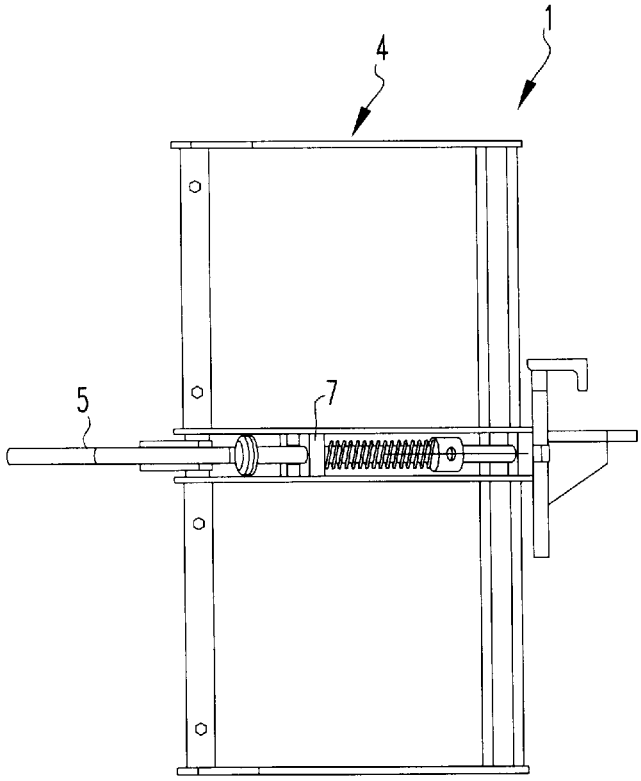
Figure 6:
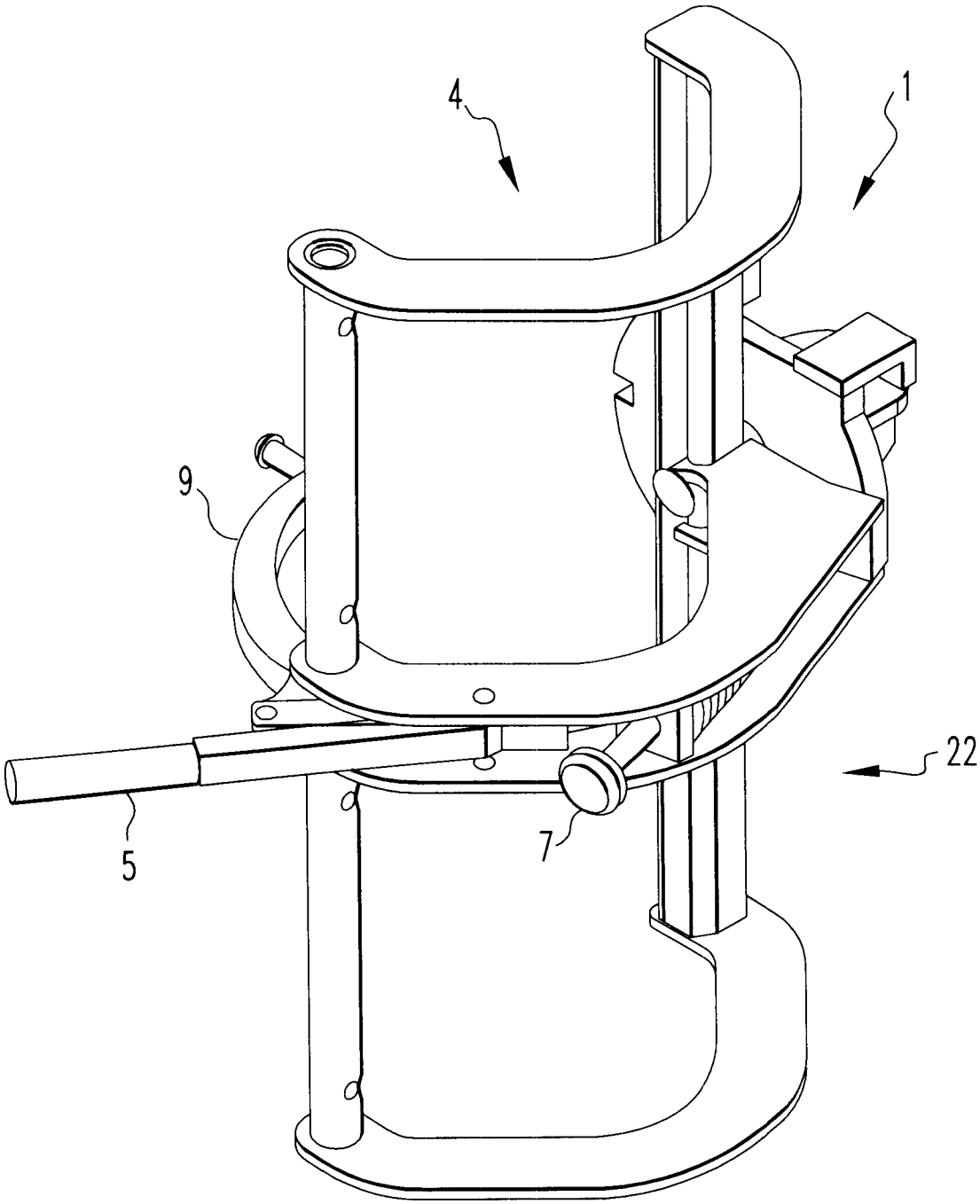
Figure 9:
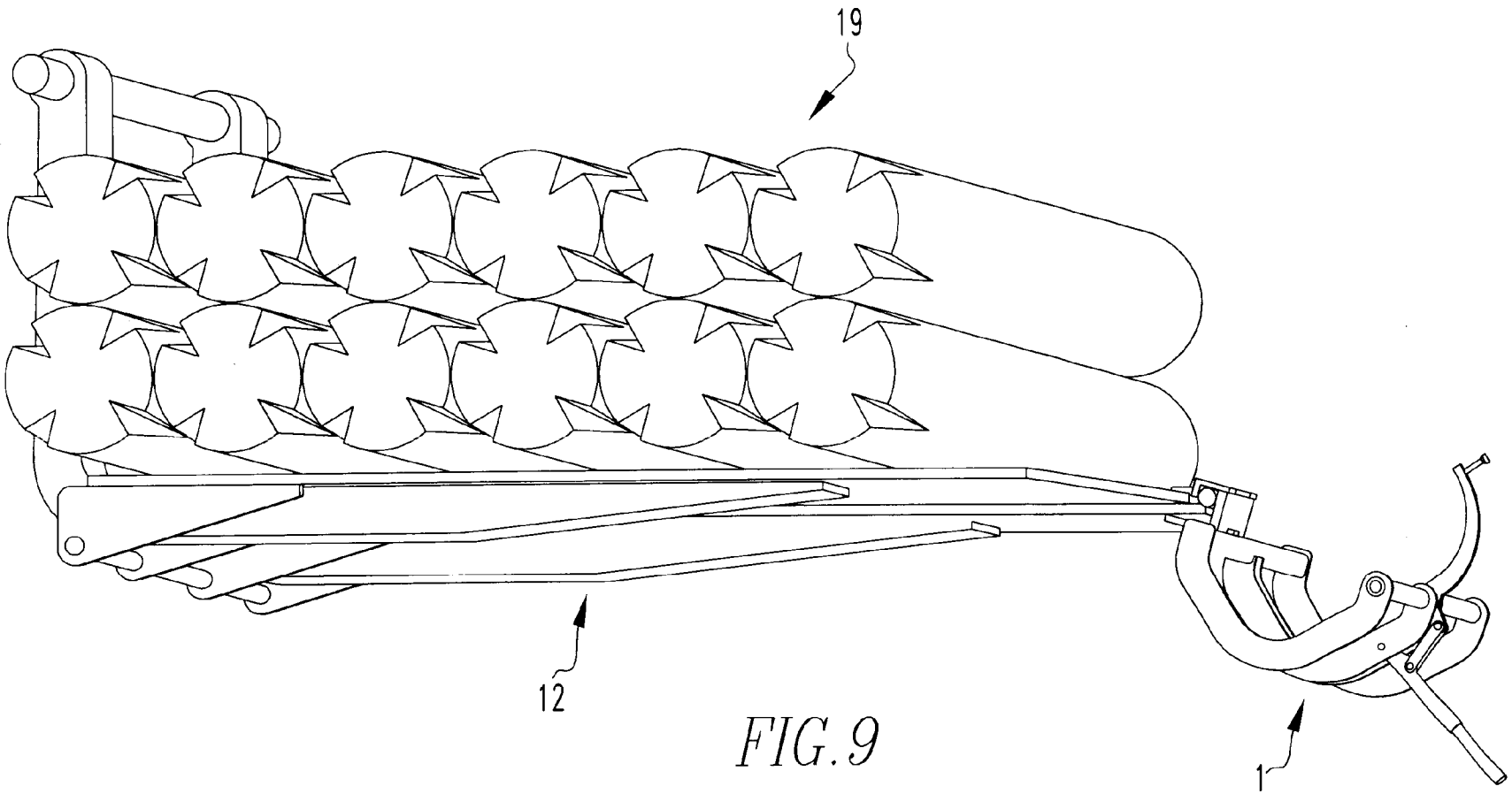
FIGS. 9, 10, 11, 12, 13 and 14 are schematic representations sequentially showing the use of the present invention to place a support in a mine.
Figure 10:
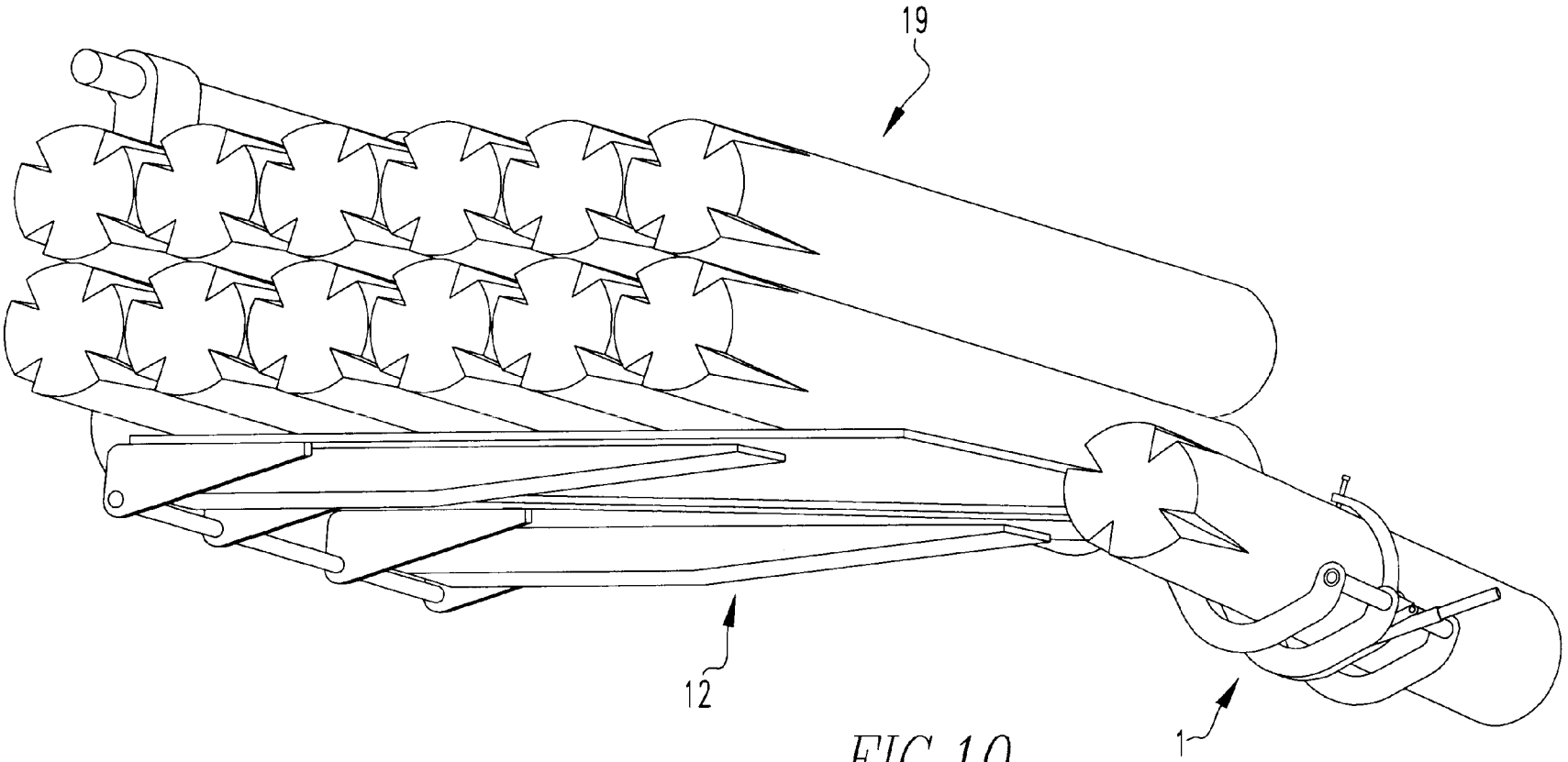
Figure 11:
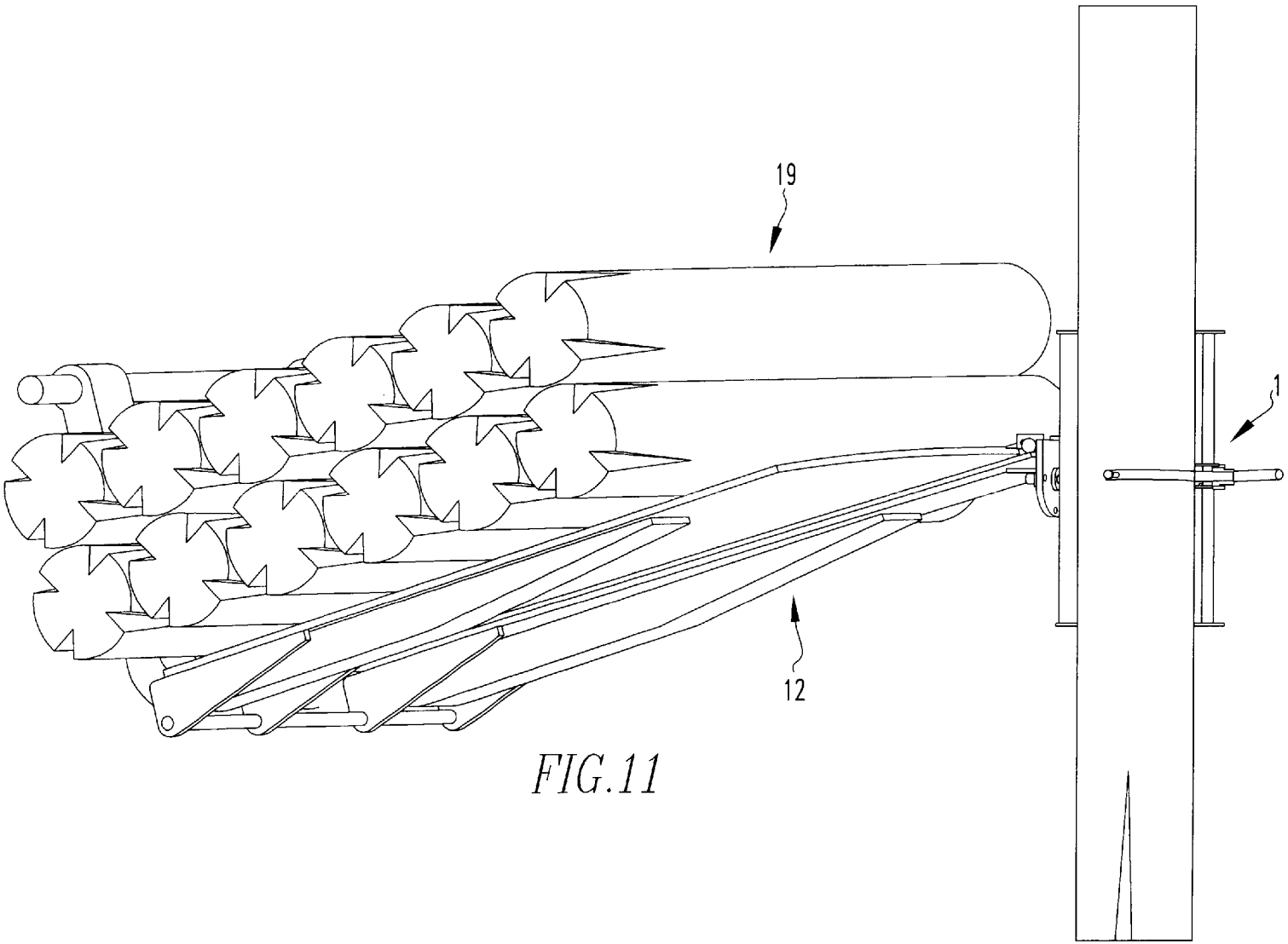
Figure 12:
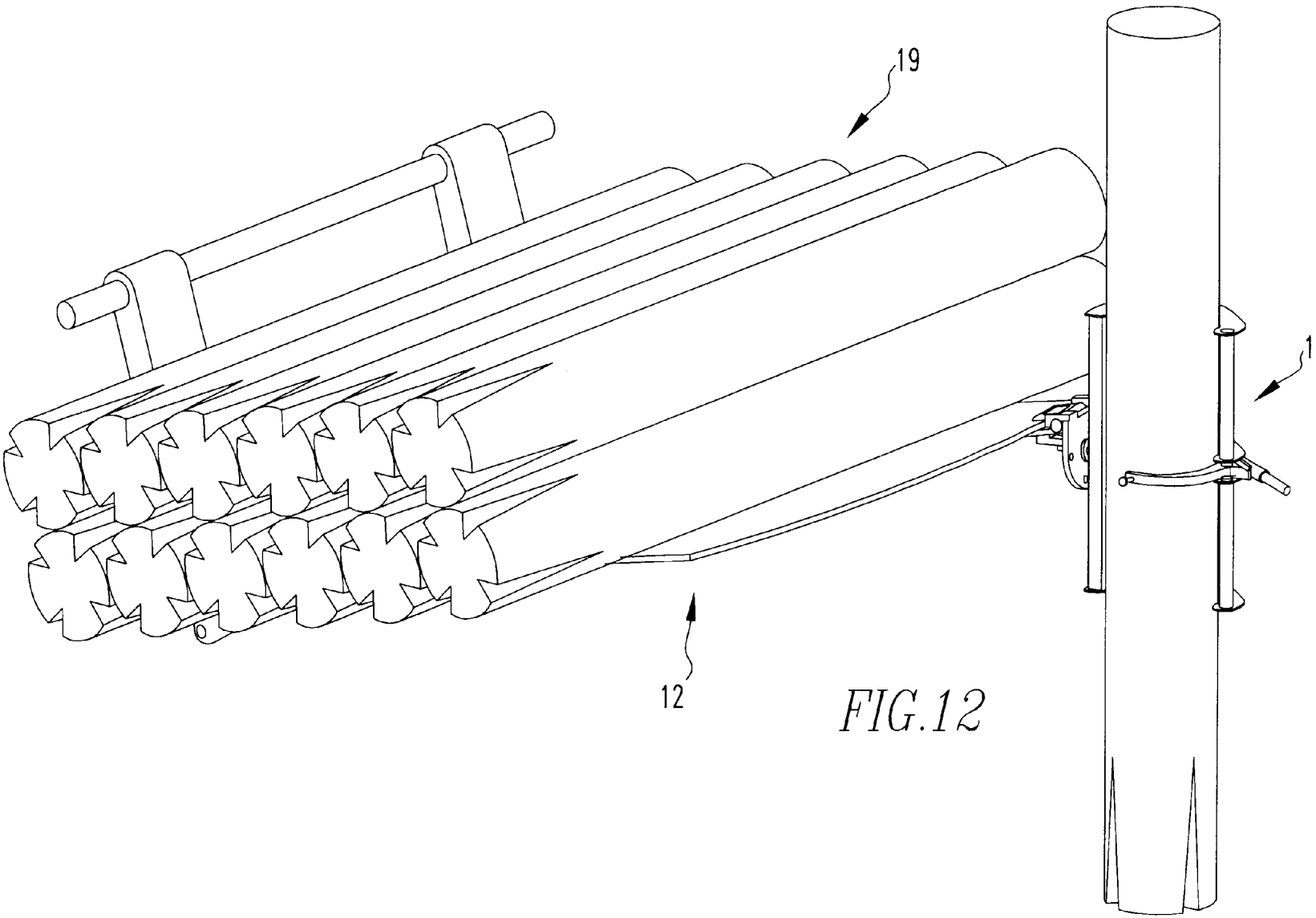
Figure 13:
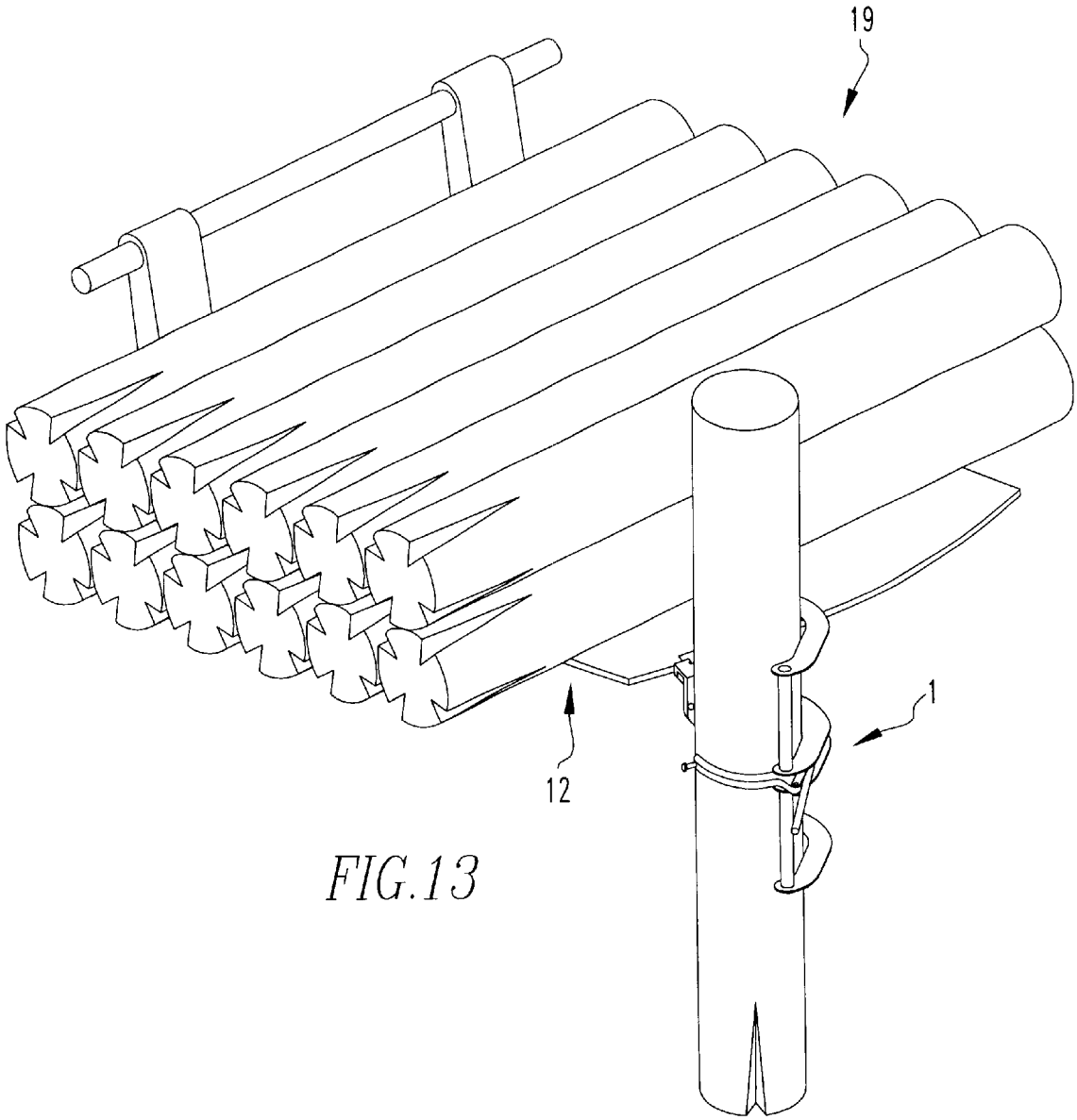
Figure 14:
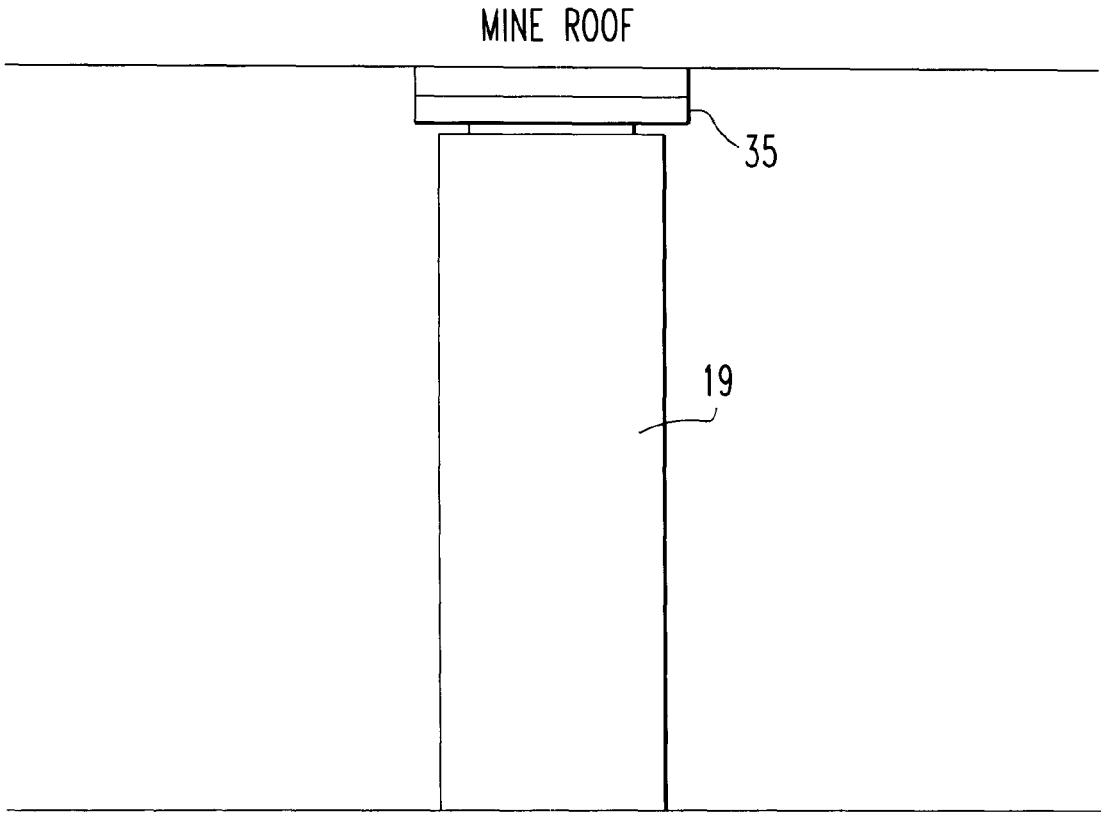

Referring now to the drawings wherein like reference numerals refer to similar or identical parts throughout the several views, and more specifically to FIGS. 1–8 thereof, there is shown a cradle 1 for placing a support 19 in a mine. The cradle 1 comprises a housing 4 for holding the mine support 19. The cradle 1 comprises an arm mechanism 22 rotatably attached to the housing 4 which has an open position that allows the support 19 to enter the housing 4 and a closed position which prevents the support 19 from leaving the housing 4. The cradle 1 comprises an attachment mechanism 24 connected to the housing 4 for rotatably attaching the housing 4 to a platform 12 of a mechanism for moving the mine support 19, such as a forklift. The attachment mechanism 24 maintains the housing 4 in the horizontal position or a vertical position.

Figure 24:
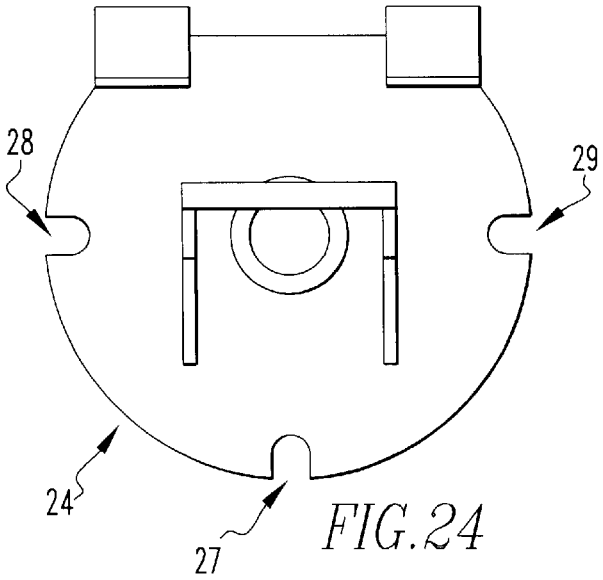
Figure 25:
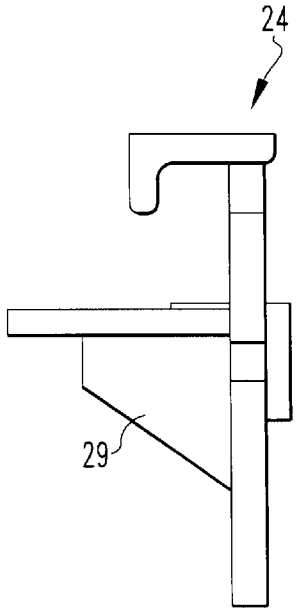

Preferably, the arm mechanism 22 includes an arm 9 rotatably attached to the housing 4 which has an open position that allows the support 19 to enter the housing 4 and a closed position which prevents the support 19 from leaving the housing 4, and a handle 5 connected to the arm 9 which moves the arm 9 when the handle is moved. The arm 9 has a locked position which holds the arm 9 in the closed position. The attachment mechanism 24 preferably has a spring loaded bolt and a plurality of holes, as shown in FIG. 24, in which the spring loaded bolt 7 can be disposed to maintain the housing 4 in the horizontal or vertical position.

The present invention pertains to a method for placing a support 19 in a mine, as shown in FIGS. 9–14. The method comprises the steps of moving a support 19 from a platform 12 to a cradle 1. Then there is the step of rotating the cradle 1 until the support 19 is in a vertical position relative to ground. Next there is the step of placing the support 19 on the ground. Then there is the step of separating the support 19 from the cradle 1. Next there is the step of tightening the support 19 to the mine roof.

In the operation of the invention, the cradle 1 is attached to the platform 12 of a forklift. This is accomplished in the following way.

Figure 15:
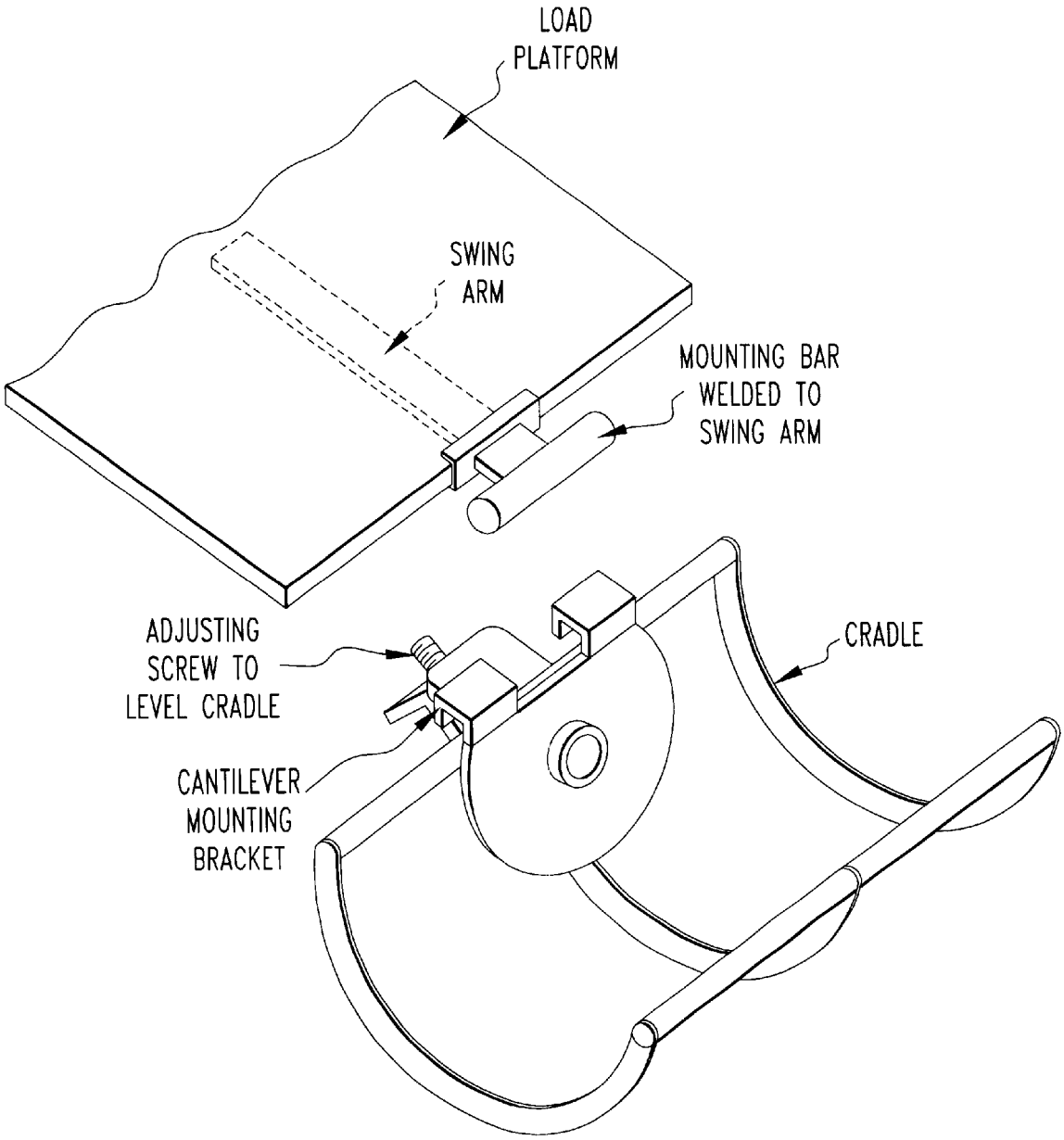
FIG. 15 is a schematic representation of a cradle and a platform.
Figure 16:
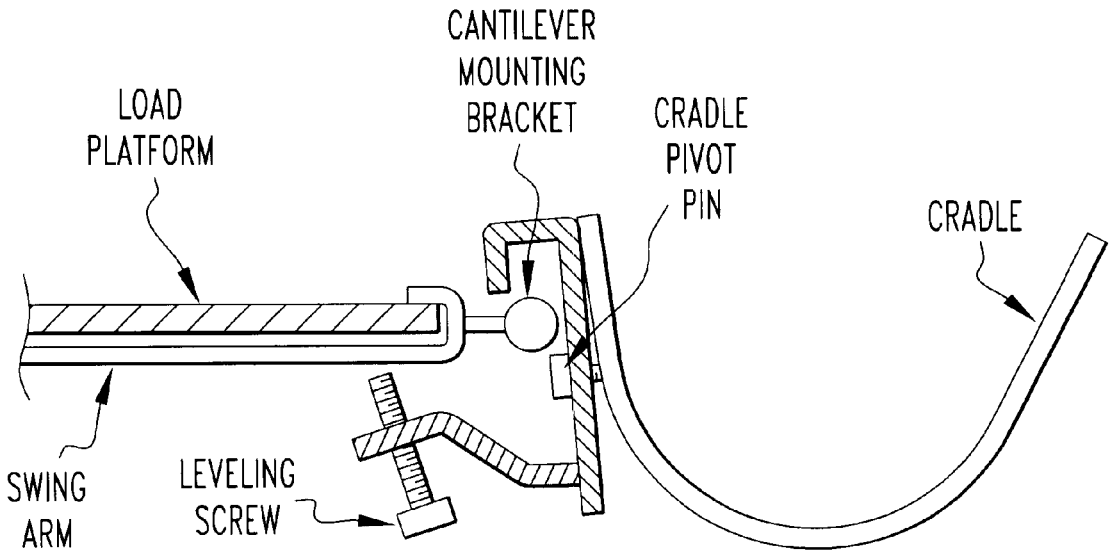
FIG. 16 is a schematic representation of a side view of the cradle and attachments to the platform.
Figure 17:
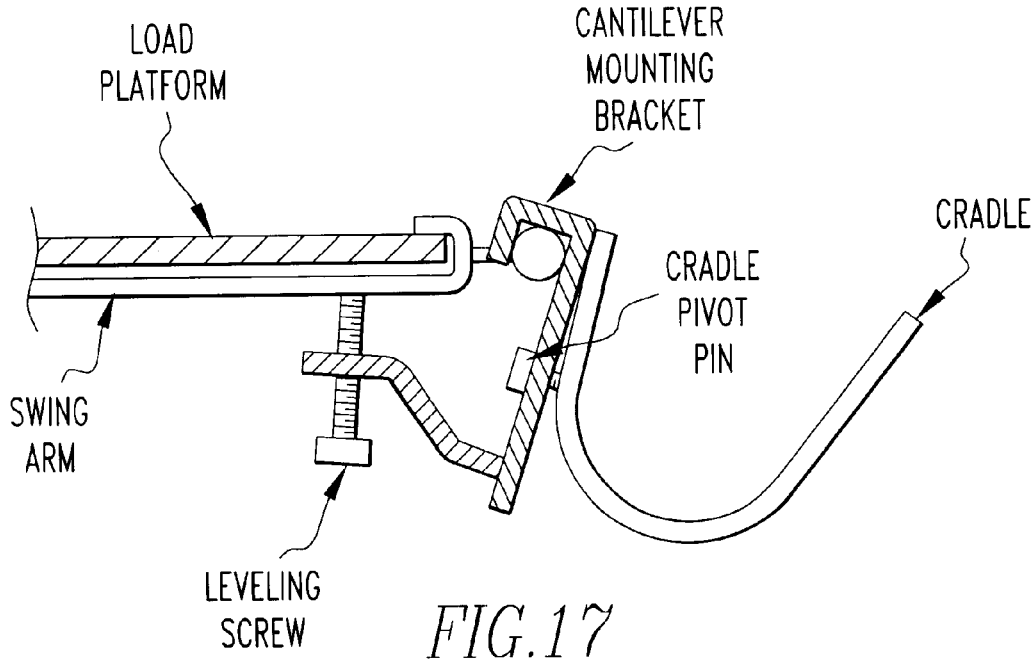
FIG. 17 is a schematic representation of a cradle in attachment with a platform.
Figure 18:
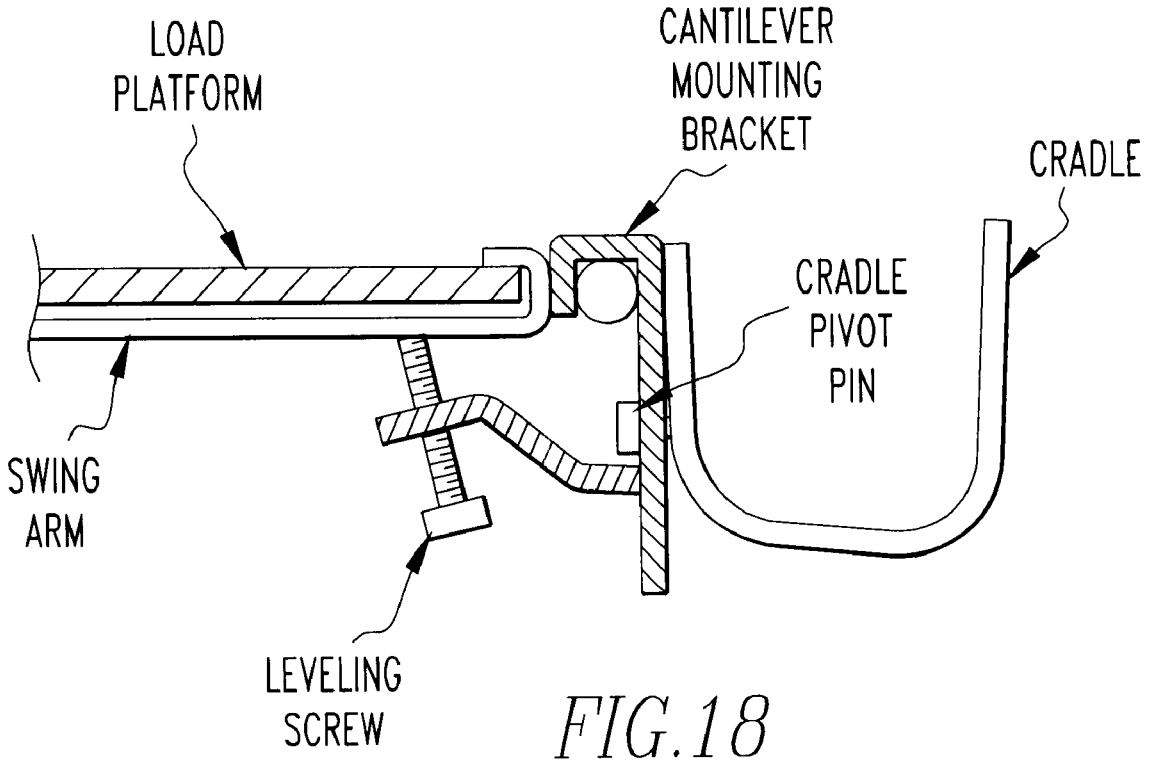
FIG. 18 is a schematic representation of a side view of a cradle in attachment with a platform.

Referring to FIG. 15, a round mounting bar 3 is fastened by bolts or welded to the front face of the swing arm or alternatively to the front end of the load platform. The cantilever mounting bracket 24 formed from steel plate has a rectangular top section, a flat mid-section which has a hole to accept the cradle pivot pin and a lower rear section with a leveling screw. The cradle is fixed to the cantilever mounting bracket with a retain ring or threaded nut, as shown in FIG. 16, the cradle and cantilever mounting bracket are positioned over the mounting bar. As shown in FIG. 17, the cradle and cantilever mounting bracket are lowered onto mounting bar and will tend by gravity to rotate around bar until leveling screw contacts bottom of swing arm or load platform if swing arm is not used. As shown in FIG. 18, by adjusting leveling screw in or out the cradle position can be adjusted to provide a vertical plane for the cradle to pivot and to securely retain the cantilever mounting bracket onto the mounting bar.

Figure 19:
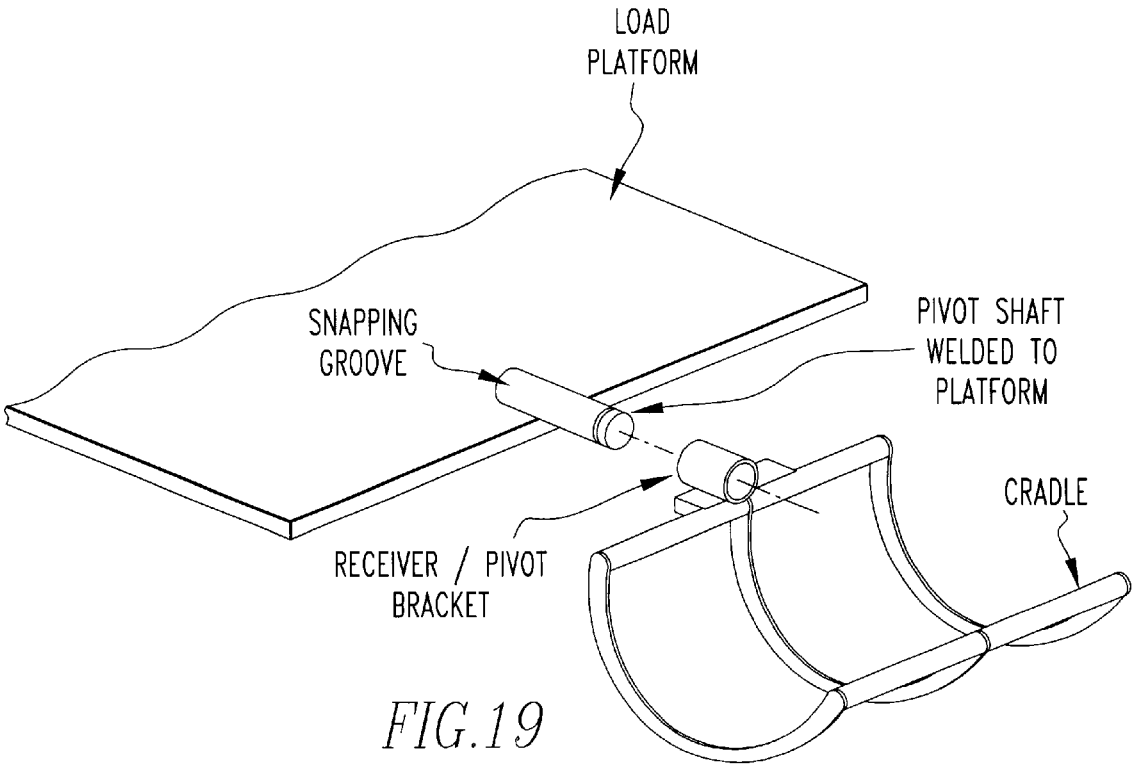
FIG. 19 is a schematic representation of a cradle and a platform in an alternative embodiment.
Figure 20:
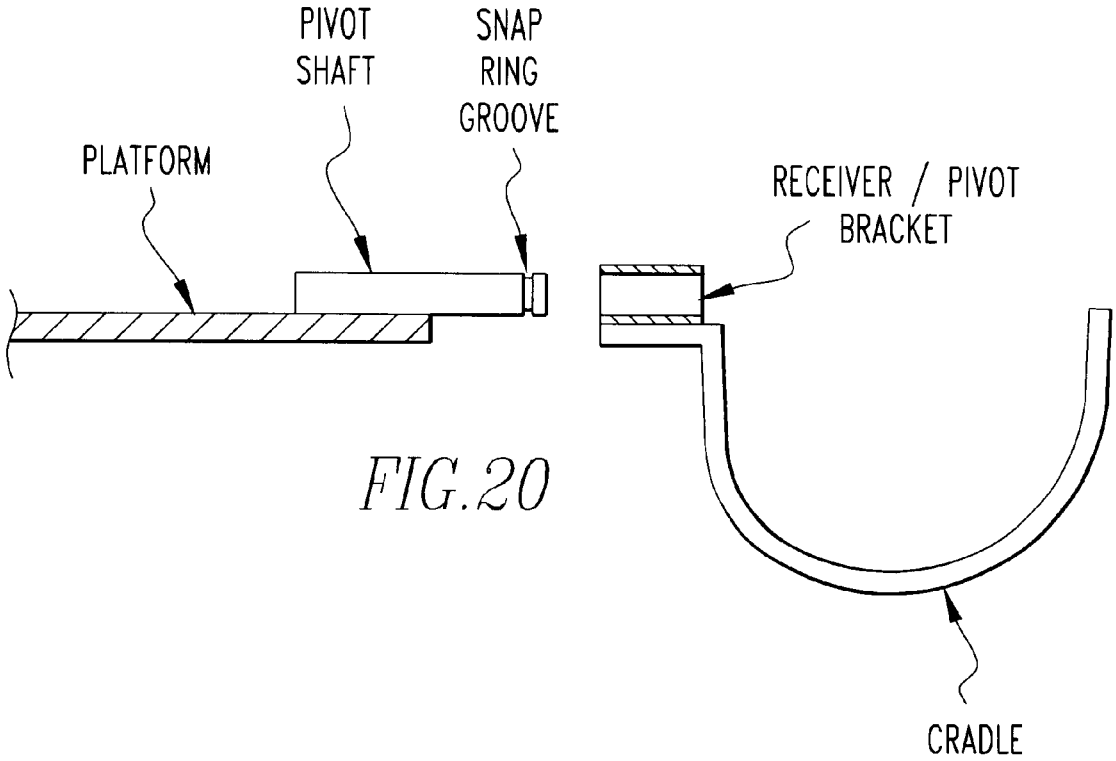
FIG. 20 is a schematic representation of a side view of a cradle in attachment with a platform of the alternative embodiment.
Figure 21:
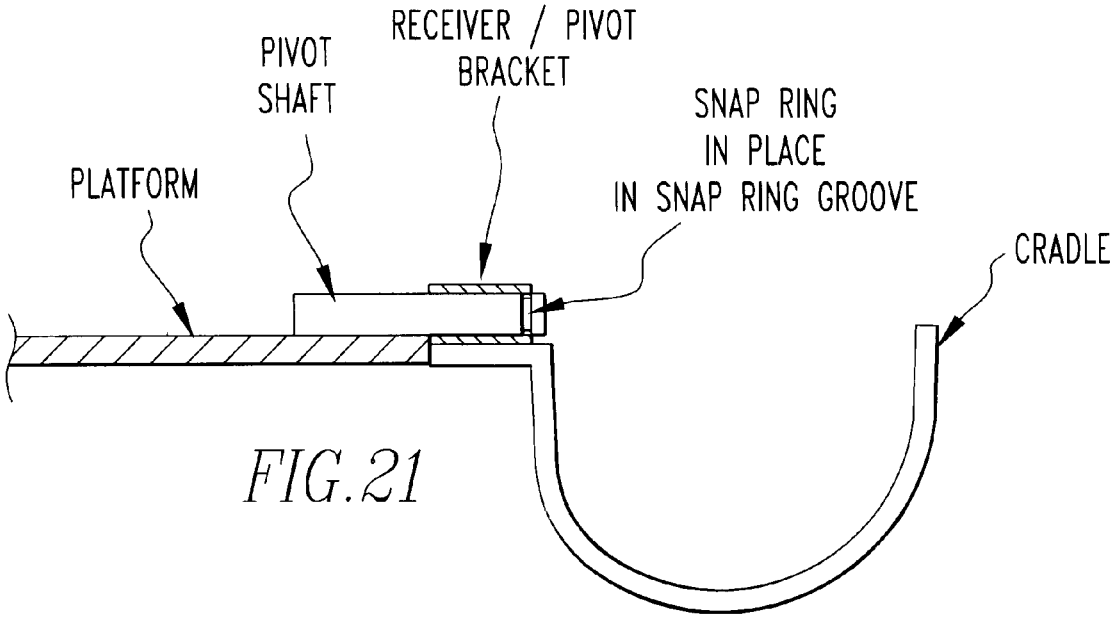
FIG. 21 is a schematic representation of a side view of a cradle in attachment with a platform of the alternate embodiment.
Figure 22:
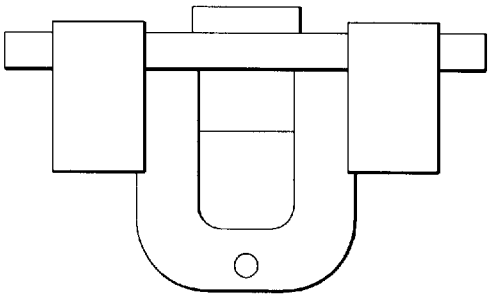
FIGS. 22, 23, 24 and 25 are schematic representations of various views of an attachment mechanism.
Figure 23:
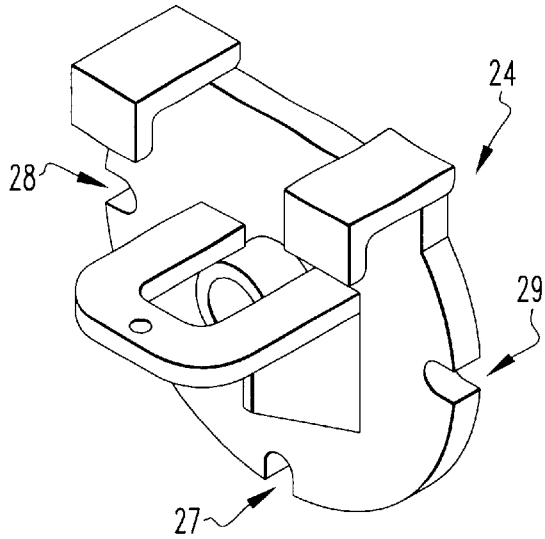

With respect to FIG. 19, an alternative mounting method of the cradle to the load platform or swing arm is to weld or bolt the pivot shaft to load platform or swing arm. The pivot shaft is equipped with a snap ring groove, pin hole or threaded. This feature will accept a snap ring, pin or locking nut to hold receiver/pivot bracket and cradle to the shaft once installed. Receive/pivot bracket made of steel tube is rigidly mounted to cradle by bolting or welding. As shown in FIG. 20, the receive/pivot bracket/cradle assembly is positioned in axial alignment to the pivot shaft. As shown in FIG. 21, the receiver/pivot bracket/cradle assembly slides onto the pivot shaft and a snap ring, pin or lock-nut is placed on the end of the pivot shaft to securely hold the cradle assembly on the shaft.

Referring to FIGS. 5–14, the cradle 1 housing 4 holds a support 19. The housing 4 is positioned so that it is parallel with the surface of the platform 12. The housing 4 is locked in this position by a spring loaded bolt 7 being inserted into the middle hole in the attachment mechanism of the cradle 1 which connects the cradle 1 to the platform 12. By the spring loaded bolt 7 being positioned in the middle hole 27, the cradle 1 is held in position parallel to the platform 12.

The platform 12 is then slowly angled downward under the operation of the forklift so the support 19 rolls forward into the housing 4. Alternatively, two men can roll a support 19 into the housing 4. The operator then grabs the handle 5 which is in an open position. The handle 5 is then free to swing upwards causing the arm 9 connected to the handle 5 to move over the housing 4 and position itself about the support 19 to capture the support 19 from the opposing side relative to the housing 4. The operator then collapses the handle, which locks the handle in place, as is well known in the art, and locks the arm in place.

The arm 9 has a pin 6 at its end which can be adjusted up or down by screwing it to more securely hold the arm 9 against the housing 4 and put pressure on it. The housing 4 is comprised of four separate but parallel ribs 18 connected to each other through a first rod 16 at a first end of the ribs 18 and a second rod 17 at the second end of the ribs 18. The middle two ribs have the handle and spring loaded bolt connected between them and arm 9 connected to it.

As shown in FIGS. 5 and 22–25, the spring loaded bolt 7 is then pulled back from the middle hole 27 allowing the cradle 1 to now rotate either clockwise or counter clockwise, depending on what the operator desires. By the operator placing a slight force or bias on one side of the support 19, gravity starts taking effect which causes the support 19 to rotate to a vertical position with the cradle 1 also moving into a vertical position in unison with the support 19 that it holds. The operator then places the spring loaded bolt 7 into the hole that is now aligned with the bolt (depending on which way the support 19 rotated) which locks the cradle 1 in place with the support 19. The support 19 cannot fall out of the housing 4 since the arm 9 is positioned around it as it goes to the vertical position.

Once the support 19 is in the vertical position, the support 19 can be placed upright on the ground and the bolt holding the handle 5 is removed. The handle 5 then is moved back to an open position and the forklift or swing arm can swing sideways separating the housing 4 from the support 19. The support 19 can then be wedged to the mine roof ceiling with wedges 35 being inserted between the top of the support 19 and the mine roof, as is well known in the art and shown in FIG. 14. The forklift with the platform 12 can then be moved to the next position in the mine where a support 19 is desired and the process is repeated.

What is described is a way of maneuvering the mine support, which is easily attached and removed from the mobile underground equipment. The cradle is mounted on the front end of the forklift, bucket or duckbill type load-carrying end. The cradle 1 can be secured in position by either a single pin or a cantilever lock system.

The cradle 1 does not require hydraulic power to hold or maneuver the support thus is substantially less complex than clamp devices. The mass of the support is balanced in the cradle 1 such that only a slight manual effort is required to maneuver the support 19. The cradle 1 can also provide 360 degree rotation capability and a rotation position locking means to hold the support at a desired angle during the installation process. The cradle 1 also provides a means of securely holding the support in the cradle 1 while it is being maneuvered into position.

The rotation and positioning of the heavy supports is accomplished with this cradle 1 with very low physical effort. The cradle 1 is designed to provide a support receiving area which is sized to create an aligned relationship between the approximate center of mass of the support to be handled and the rotating axis. The cradle also provides the feature of allowing the support to rotate by force of gravity to a substantially upright position by slightly off-setting the center of mass laterally of the rotation axis of the cradle.

One preferred configuration of the cradle 1 would incorporate a load carrying platform 12 which is adapted to slide onto the forklift, bucket or duckbill front end of a scoop. The cradle 1 can be easily attached and removed from this load carrying platform 12. The supports 19 would be carried on this load platform and pushed or rolled into the cradle 1 for rotating and positioning the support 19.

Another configuration of the cradle 1 would incorporate a swing arm to allow for lateral movement of the support for proper positioning. This will also allow the cradle 1 to be removed from the support without the repositioning of the entire scoop.

In another configuration of the cradle 1, the cradle 1 would be mounted to be directly to the front of a bucket type scoop. This mounting could be fixed or with a swing arm which provides lateral movement of the cradle 1 along the front of the bucket.

Yet another configuration would be the mounting of the cradle 1 directly to a scoop duckbill platform. The mounting could be fixed or with a swing arm to allow lateral movement of the cradle along the front of the duckbill platform.

One method of use of the cradle 1 is as follows:

1. In the first preferred configuration, a forklift type scoop slides under and picks up the load-carrying platform.
2. A bundle of supports can then be picked up and carried on this platform to the location where the supports are to be installed.
3. The cradle 1 is then quickly attached to the load-carrying platform.
4. The bundle of supports is opened and each support may be rolled or pushed into the cradle 1 for maneuvering and installation.
5. After all supports of that bundle are installed, the cradle 1 is removed and the Scoop can retrieve another bundle of supports for installation.

It can be appreciated that if the cradle 1 could not be easily and quickly attached and removed from the load carrying platform that retrieving the support bundles could be a very time consuming task. The process would likely require additional equipment or provisions for placing the supports on the load-carrying platform.

The key points of the cradle are:

1. A device to maneuver a support from a horizontal position to a vertical position.
2. A device which requires no external power source other than slight human effort or the force of gravity alone.
3. A device very quick to mount and dismount from all configurations of mobile underground "Scoops".

The detailed use of the cradle in the installation of the support is as follows:

1. Supports are loaded on the platform.
2. Cradle is installed by either:
   Sliding receiver/pivot bracket and cradle over the pivot shaft and securing with a locking pin, retaining ring or nut.
   Inserting frame and rotator assembly into channel for cantilever lock attachment.
3. Roll or push support into cradle from the load platform.
4. Secure support in position with over-center lock system.
5. Release rotation position control lock.
6. Rotate support to vertical position.
7. Swing arm mechanism can be used for lateral positioning of support.
8. Once support is located properly release over-center lock mechanism to allow support to stand free.
9. Use swing arm mechanism to move cradle away from support.
10. Rotate the cradle back to the horizontal position.
11. Roll or push another support into the cradle.
12. After all supports on platform are installed, remove cradle. Scoop may then retrieve more supports for installation.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A cradle for placing a support in a mine, the cradle attaching to a platform for holding the mine support, the platform being associated with a mechanism for moving the platform, the cradle comprising:

a holder for holding the mine support, the holder having an edge;

an arm mechanism rotatably attached to the holder which has an open position that allows the support to enter the holder and a closed position which prevents the support from leaving the holder; and an attachment mechanism connected to the holder for rotatably attaching the holder to the platform, the attachment mechanism maintaining the holder in a horizontal position relative to the platform with the entire edge of the holder in parallel with the surface of the platform and at a level no higher than the level of the platform so the mine support can roll from the platform to the holder and enter the holder or in a vertical position relative to the platform.

2. A cradle as described in claim 1 wherein the arm mechanism includes an arm rotatably attached to the holder which has an open position that allows the support to enter the holder and a closed position which prevents the support from leaving the holder, and a handle connected to the arm which moves the arm when the handle is moved, the arm having a locked position which holds the arm in the closed position.

3. A cradle as described in claim 2 wherein the holder includes a housing which is maintained in a position parallel with the surface of the platform when the arm mechanism is in the open position.

4. A cradle as described an claim 3 wherein the attachment mechanism has a spring loaded bolt and a plurality of holes in which the spring loaded bolt can be disposed to maintain the holder in the horizontal or vertical position.

5. A cradle as described in claim 3 wherein the arm includes a pin to hold the arm against the housing.

6. A cradle as described in claim 5 wherein the attachment mechanism includes a cantilever mounting bracket that mates with a mounting bar of the platform.

7. A cradle as described in claim 6 wherein the cantilever mounting bracket includes a leveling screw which contacts the platform when the mounting bracket is in place on the mounting bar.

8. A cradle as described in claim 7 wherein the attachment mechanism includes one of a retaining ring and a threaded nut that is used to fix the housing to the cantilever mounting bracket.

9. A cradle as described in claim 8 wherein the cantilever mounting bracket includes a steel plate having a top section, a mid-section which has a hole to accept the bolt when the housing is held in a parallel position and a lower rear section with the leveling screw.

10. A cradle for placing a support in a mine, the cradle attaching to a platform for holding the mine support, the platform being associated with a mechanism for moving the platform, the cradle comprising:

a holder for holding the mine support;

an arm mechanism rotatably attached to the holder which has an open position that allows the support to enter the holder and a closed position which prevents the support from leaving the holder, the arm mechanism includes an arm rotatably attached to the holder which has an open position that allows the support to enter the holder and a closed position which prevents the support from leaving the holder, and a handle connected to the arm which moves the arm when the handle is moved, the arm having a locked position which holds the arm in the closed position, the holder includes a housing which is maintained in a position parallel with the surface of the platform when the arm mechanism is in the open position; and an attachment mechanism connected to the holder for rotatably attaching the holder to the platform, the attachment mechanism maintaining the holder in a horizontal position relative to the platform so the mine support can roll from the platform to the holder and enter the holder or in a vertical position relative to the platform, the attachment mechanism has a spring loaded bolt and a plurality of holes in which the spring loaded bolt can be disposed to maintain the holder in the horizontal or vertical position.

* * * * *